US009911394B2

(12) United States Patent
Wu et al.

(10) Patent No.: US 9,911,394 B2
(45) Date of Patent: Mar. 6, 2018

(54) METHOD AND APPARATUS FOR CONTROLLING IMAGE DISPLAY

(71) Applicant: BOE Technology Group Co., Ltd., Beijing (CN)

(72) Inventors: Zhongyuan Wu, Beijing (CN); Haijing Chen, Beijing (CN); Chunsheng Jiang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 723 days.

(21) Appl. No.: 13/964,785

(22) Filed: Aug. 12, 2013

(65) Prior Publication Data

US 2014/0063080 A1 Mar. 6, 2014

(30) Foreign Application Priority Data

Sep. 4, 2012 (CN) ..... 2012 1 0324162

(51) Int. Cl.
*G09G 5/10* (2006.01)
*G09G 3/3225* (2016.01)

(52) U.S. Cl.
CPC ..... *G09G 5/10* (2013.01); *G09G 3/3225* (2013.01); *G09G 2320/0233* (2013.01);
(Continued)

(58) Field of Classification Search
CPC ..... G09G 5/10; G09G 3/3225; G09G 2320/0276; G09G 2320/0285;
(Continued)

(56) References Cited

U.S. PATENT DOCUMENTS 8,446,493 B2 * 5/2013 Utsugi ..... H04N 1/409 348/222.1
8,749,465 B2 * 6/2014 Ho et al. ..... 345/94
(Continued)

FOREIGN PATENT DOCUMENTS

CN 101334958 A 12/2008
CN 101727868 A 6/2010

OTHER PUBLICATIONS

Third Office Action issued by the Chinese Patent Office for Chinese Patent Application No. 201210324162.1 dated Jan. 19, 2015, five (5) pages.

(Continued)

*Primary Examiner* — Jonathan Horner
(74) *Attorney, Agent, or Firm* — Ladas & Parry LLP

(57) ABSTRACT

The present disclosure discloses a method and an apparatus for controlling image display, which achieve uniformity of image display and remove the image-retention in a compensation manner of high precision, high efficiency and low cost. The method for controlling image display comprises: reading gray scales of all sub-pixels of a current frame image displayed by a display device; determining an ideal luminance corresponding to the gray scale according to a predetermined ideal corresponding relationship between the gray scales and luminance of respective sub-pixels respectively; determining an adjusted gray scale corresponding to the ideal luminance according to the predetermined original corresponding relationship between the gray scales and the luminance of respective sub-pixels respectively; driving the display device to display the current frame image according to the adjusted gray scale.

3 Claims, 5 Drawing Sheets

(52) U.S. Cl.
CPC ..... *G09G 2320/0271* (2013.01); *G09G 2320/0276* (2013.01); *G09G 2320/0285* (2013.01); *G09G 2320/0295* (2013.01); *G09G 2320/043* (2013.01); *G09G 2320/045* (2013.01); *G09G 2320/046* (2013.01); *G09G 2320/0693* (2013.01); *G09G 2360/147* (2013.01); *G09G 2360/16* (2013.01)

(58) Field of Classification Search
CPC ..... G09G 2320/0693; G09G 2320/043; G09G 2320/0233; G09G 2320/0271; G09G 2320/046; G09G 2320/045; G09G 2320/0295; G09G 2360/147; G09G 2360/16
See application file for complete search history.

(56) References Cited

U.S. PATENT DOCUMENTS

2003/0210256 A1* 11/2003 Mori et al. ..... 345/690
2004/0183759 A1* 9/2004 Stevenson et al. ..... 345/82
2006/0262147 A1* 11/2006 Kimpe ..... G09G 3/20 345/690
2007/0002035 A1* 1/2007 Plut ..... G06F 1/3218 345/211
2007/0279323 A1* 12/2007 Park et al. ..... 345/55
2008/0170014 A1* 7/2008 Jung et al. ..... 345/82
2008/0180375 A1* 7/2008 Wang ..... 345/89
2009/0058836 A1* 3/2009 Kang et al. ..... 345/204
2013/0050528 A1* 2/2013 Hsu ..... H04N 9/045 348/234

OTHER PUBLICATIONS

English translation of Third Office Action issued by the Chinese Patent Office for Chinese Patent Application No. 201210324162.1 dated Jan. 19, 2015, three (3) pages.
First Office Action issued by the Chinese Patent Office for Chinese Patent Application No. 201210324162.1 dated Apr. 1, 2014, 9pgs.
English translation of First Office Action issued by the Chinese Patent Office for Chinese Patent Application No. 201210324162.1 dated Apr. 1, 2014, 9pgs.
Second Office Action issued by the Chinese Patent Office for Chinese Patent Application No. 201210324162.1 dated Aug. 22, 2014, 8pgs.
English translation of Second Office Action issued by the Chinese Patent Office for Chinese Patent Application No. 201210324162.1 dated Aug. 22, 2014, 8pgs.
Extended European Search Report for European Patent Application No. 13182797.4 dated Dec. 5, 2013, 10pgs.

* cited by examiner

METHOD AND APPARATUS FOR CONTROLLING IMAGE DISPLAY

CROSS REFERENCE TO RELATED APPLICATIONS

This application claims priority from Chinese National Application No. 201210324162.1, filed on Sep. 4, 2012, the contents of which are incorporated herein by reference.

FIELD

The present disclosure relates to a technical field of image display, and more particularly to a method and an apparatus of controlling image display.

BACKGROUND

Organic Light Emitting Diode (OLED) is considered as next generation of perfect display device due to its advantages of high color saturation, wide visual angle, low energy consumption, high luminance, and simple device structure and so on.

At present, large size of OLED display device is realized, but two problems of non-uniformity and image-retention of display still exist in terms of luminance. The display non-uniformity of luminance mainly results from a non-uniformity of electrics performance of Thin Film Transistor (TFT) in back plane and internal resistance (IR) drop produced from implementation of image drive. The image-retention is a kind of image-retention due to aging OLED and TFT device, which basically results from an attenuation degree of TFT and OLED of a display area due to long time illumination of the display area is greater than the attenuation degree of TFT of another display area. With respect to these two problems, improvement is usually done by adopting a control technology of image display during making image drive.

The method of controlling image display comprises internal compensation and external compensation. The internal compensation means a method of making compensation by a sub circuit constructed with TFT inside a sub-pixel. The external compensation means a method of extracting a TFT and OLED signal out of the back plane and then controlling image display by means of external application specific integrated circuit (ASIC). Sub-pixel structure and driving manner of the internal compensation is generally complicated, the compensation effect is merely limited to TFT threshold voltage and IR Drop, and the problem of image-retention can not be removed. Meanwhile, in large size of display device with high resolution and high refresh frequency, the method of internal compensation results in problems of decreased aperture ratio and slow driving speed. The manner of external compensation has advantages of simple sub-pixel structure, fast driving speed and good compensation effect, and thus external compensation is preferable compensation scheme in large size OLED display.

The external compensation is classified into optical extractable compensation and electrical extractable compensation. The optical extractable compensation refers to extracting luminance signal by means of optical Charge-coupled Device (CCD) photographing after the back plane is illuminated, and the electrical extractable compensation refers to extracting electrical signal of TFT and OLED by means of a induction circuit of a driving chip. The kinds of signal extracted by the two compensation methods are different, and thus data is processed in difference manner.

The optical extractable compensation has advantages of simple structure and flexibility, and thus is widely used currently.

The existing method of optically compensating image luminance is performed as follows: comparing luminance signal value obtained by CCD photographing with an ideal luminance signal value, then selecting proper gray scale offset amount $\Delta G$, and making compensation in a manner of progressive approximation. Compensation precision of this method depends on the value of $\Delta G$, and compensation range is $(2^n-1)\Delta G$, wherein n is number of measurement. Therefore, $\Delta G$ needs to be decreased in order to increase compensation precision, and only the number of measurement can be increased in order to widen the compensation range. What's more, as for every gray scale, many times of measurement and comparison are necessary, and thus it is inefficient. As shown in FIG. 1, FIG. 1 is a relationship graph of number of measurement versus luminance when image display is controlled by existing manner of progressive approximation. Since time taken by measurement is long and the amount of data processing increases, if the number of measurement is reduced, the amount of data processing will be decreased, but a requirement for compensation precision can not be met.

SUMMARY

Embodiments of the present disclosure provide a method and an apparatus for controlling image display, for achieving uniformity of image display and removing the image-retention in a compensation manner of high precision, high efficiency and low cost.

The method for controlling image display provided by the embodiment of the present disclosure comprises:

reading gray scales of all sub-pixels of a current frame image displayed by a display device;

determining ideal luminance corresponding to the gray scales according to a predetermined ideal corresponding relationship between the gray scales of respective sub-pixels and luminance respectively;

determining an adjusted gray scale corresponding to the ideal luminance according to a predetermined original corresponding relationship between the gray scales and the luminance of respective sub-pixels respectively;

driving the display device to display the current frame image according to the adjusted gray scale.

The apparatus for controlling image display provided by the embodiment of the present disclosure comprises:

a gray scale obtaining unit, for reading gray scales of all sub-pixels of a display device displaying a current frame image;

an ideal luminance determining unit, for determining ideal luminance corresponding to the gray scales according to a predetermined ideal corresponding relationship between the gray scales of respective sub-pixels and luminance respectively;

an adjusted gray scale determining unit, for determining an adjusted gray scale corresponding to the ideal luminance according to a predetermined original corresponding relationship between the gray scales and the luminance of respective sub-pixels respectively;

image display control unit, for driving the display device to display the current frame image according to the adjusted gray scale.

In the method for controlling image display provided by embodiments of the present disclosure, gray scales of all sub-pixels of a current frame image is displayed by reading a display device; determining ideal luminance corresponding to the gray scales is determined according to a predetermined ideal corresponding relationship between the gray scales and luminance of respective sub-pixels respectively; an adjusted gray scale corresponding to the ideal luminance is determined according to a predetermined original corresponding relationship between the gray scales and the luminance of respective sub-pixels respectively; the display device is driven to display the current frame image according to the adjusted gray scale. The method controls picture display uniformity of image display, and there is no phenomenon of the image-retention.

DETAILED DESCRIPTION

Figure 1:
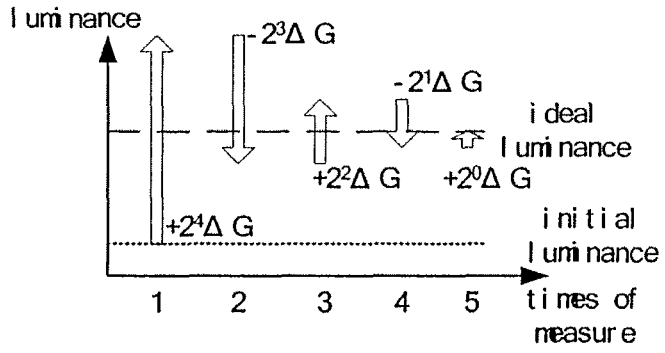
FIG. 1 is a diagram of a method of achieving a control of image display in the prior art.

Embodiments of the present disclosure provide a method and an apparatus for controlling image display, for achieving uniformity of image display and remove the image-retention in a compensation manner of high precision, high efficiency and low cost.

A luminance of the image is determined by a gray scale, and a concept of the gray scale is described simply as follows.

Usually, a point on the image displayed by a display device which is viewed by people is three sub-pixels in red, green, blue, an optical source behind each sub-pixel can be constituted of displayed in different luminance levels, and the gray scale represents different levels of luminance varying from most luminous to darkest, the more the number of the level is, the finer the displayed picture effect is. For example, 256 luminance levels is called as 256 gray scales, and a color variation of each point on the image means a variation of the gray scale of the three sub-pixels constituting the point.

The same gray scale of back plane corresponds to the same ideal luminance. The gray scales with the same gray scale value drive the back plane at the same time, and there are differences between the luminance corresponding to the respective sub-pixels. This is because problems of electrical performance instability or device aging etc. exist in some display areas during a manufacture process of sub-pixels, which renders a greater difference of luminance corresponding to the sub-pixels of back plane driven by one and the same gray scale. The problems of uniformity of image display and existence of the image-retention are produced.

The problems of electrical performance instability or device aging etc. exist in some display areas during the manufacture process of the sub-pixel are generally inevitable. In the present disclosure, the problems of uniformity of image display and existence of the image-retention can be solved by adjusting the gray scale of each sub-pixel of display device displaying a current frame image on the back plane, obtaining an adjusted gray scale corresponding to each sub-pixel, and driving back plane with the adjusted gray scale of each sub-pixel, so as to achieve an uniform display of image picture without image-retention.

In the present disclosure, as for each OLED display device before being delivered from the factory, an original corresponding relationship is obtained by testing the original corresponding relationship between the gray scales and the luminance, and an ideal corresponding relationship between the gray scales and the luminance is determined. During a procedure of actually displaying images by the display device, the gray scale of the display device displaying current frame image is adjusted based on the original corresponding relationship between the gray scales and the luminance and the ideal corresponding relationship between the gray scales and the luminance, an adjusted gray scale is obtained and rounded into an integer, then, the back plane is driven, and thus an uniform display of the image picture without image-retention is achieved.

As for each display device before being delivered from the factory, the steps as follows is necessarily performed for each sub-pixel:

Establishing the ideal corresponding relationship between the gray scales and the luminance and the original corresponding relationship between the gray scales and the luminance.

The method for controlling image display according to the embodiment of the present disclosure is described simply as follows:

The luminance corresponding to the gray scale of the display device displaying the current frame image is obtained according to the ideal corresponding relationship between the gray scales and the luminance, and the adjusted gray scale corresponding to the luminance is obtained according to the original corresponding relationship between the gray scales and the luminance. The back plane is driven with the adjusted gray scale, so as to display the image with picture uniformity is displayed.

The technical measures provided by the embodiments of the present disclosure are described as follows by referring to accompanying figures.

Figure 2:
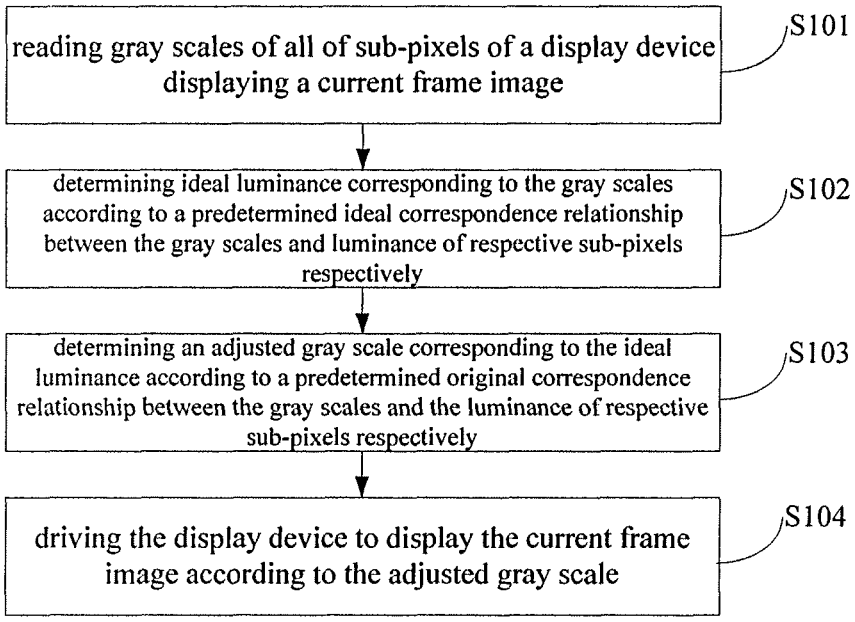
FIG. 2 is a flow chart of a method for controlling image display provided by an embodiment of the present disclosure.

By referring to FIG. 2, the method of controlling image display provided by the embodiment of the present disclosure comprises:

S101: reading gray scales of all sub-pixels of a display device displaying a current frame image.

S102: determining ideal luminance corresponding to the gray scales according to a predetermined ideal corresponding relationship between the gray scales and luminance of respective sub-pixels, respectively.

S103: determining an adjusted gray scale corresponding to the ideal luminance according to a predetermined (predetermined by measuring the back plane) original corresponding relationship between the gray scales and the luminance of respective sub-pixels, respectively.

S104: driving the display device to display the current frame image according to the adjusted gray scale.

The ideal corresponding relationship between the gray scales and the luminance of respective sub-pixels is characterized by an ideal characteristic curve of the gray scales vs. the luminance, or characterized by an ideal corresponding relationship between the gray scales and the luminance stored in a table; and The original corresponding relationship between the gray scales and the luminance of respective sub-pixels is characterized by an original characteristic curve of the gray scales vs. the luminance, or characterized by an original corresponding relationship between the gray scales and the luminance stored in a table.

When the original corresponding relationship between the gray scales and the luminance of respective sub-pixels is characterized by the original corresponding relationship between the gray scales and the luminance stored in the table, the gray scale corresponding to the luminance doesn't need to be adjusted; and When the original corresponding relationship between the gray scales and the luminance of respective sub-pixels is characterized by the original corresponding relationship between the gray scales and the luminance stored in the table, the gray scale corresponding to the gray scale need not to be adjusted; and When the original corresponding relationship between the gray scales and the luminance of respective sub-pixels is characterized by the original corresponding relationship between the gray scales and the luminance stored in the table, the gray scale corresponding to the luminance doesn't need to be adjusted. This is because the gray scale values stored in the table are adjusted gray scale values which have been rounded into integers, and the adjusted gray scale for driving the display device to display the current frame image can be looked up in a manner of directly looking for the table.

If the ideal corresponding relationship between the gray scales and the luminance of respective sub-pixels is characterized by the ideal characteristic curve of the gray scales vs. the luminance, the ideal characteristic curve of the gray scale vs. the luminance of sub-pixel is determined particularly as follows:

Determining the ideal corresponding relationship between a plurality of gray scales and the luminance of each sub-pixel; making interpolation calculation on the ideal corresponding relationship between the plurality of gray scales and the luminance of each sub-pixel, and obtaining the ideal characteristic curve of the gray scale vs. the luminance of the sub-pixel.

Preferably, the ideal corresponding relationship between the plurality of gray scales and the luminance of each sub-pixel is determined particularly as follows:

Selecting a plurality of different gray scales, driving the display device with the gray scales respectively to display images corresponding to the gray scales; measuring and recording the luminance of all the sub-pixels corresponding to each gray scale among the displayed images; summing and averaging the luminance of the plurality of sub-pixels corresponding to each gray scale respectfully, obtaining the ideal luminance corresponding to the selected gray scales, obtaining the ideal corresponding relationship between the plurality of selected gray scales and the luminance of each sub-pixel.

If the original corresponding relationship between the gray scales and the luminance of respective sub-pixels is characterized by the original characteristic curve of the gray scales vs. the luminance, the original characteristic curve of the gray scale vs. the luminance of the sub-pixels is determined particularly as follows:

Predetermining the original corresponding relationship between a plurality of gray scales and the luminance of each sub-pixel; making interpolation calculation on the original corresponding relationship between the plurality of gray scales and the luminance of each sub-pixel, and obtaining the original characteristic curve of the gray scale vs. the luminance of the sub-pixel.

Preferably, the original corresponding relationship between the plurality of gray scales and the luminance of each sub-pixel is predetermined, particularly as follows:

Selecting a plurality of different gray scales, driving the display device with the gray scales respectively to display images corresponding to the gray scales; measuring and recording the luminance of all the sub-pixels corresponding to each gray scale among the displayed images; obtaining the luminance corresponding to the selected different gray scales of each sub-pixel; and obtaining the original corresponding relationship between the plurality of selected gray scales and the luminance of each sub-pixel.

The following descriptions involve in detail the determination of the ideal characteristic curve of the gray scales vs. the luminance of each sub-pixel, and the determination of the original characteristic curve of the gray scales vs. the luminance of the respective sub-pixels by measuring the back plane.

It is supposed that a certain display device comprises sub-pixels in I (I=1, 2, 3, 4, . . . ) rows and J (J=1, 2, 3, 4, . . . ) columns, and the sub-pixels comprise three kinds of sub-pixels is red, green, blue (R, G, B sub-pixels).

Figure 3:
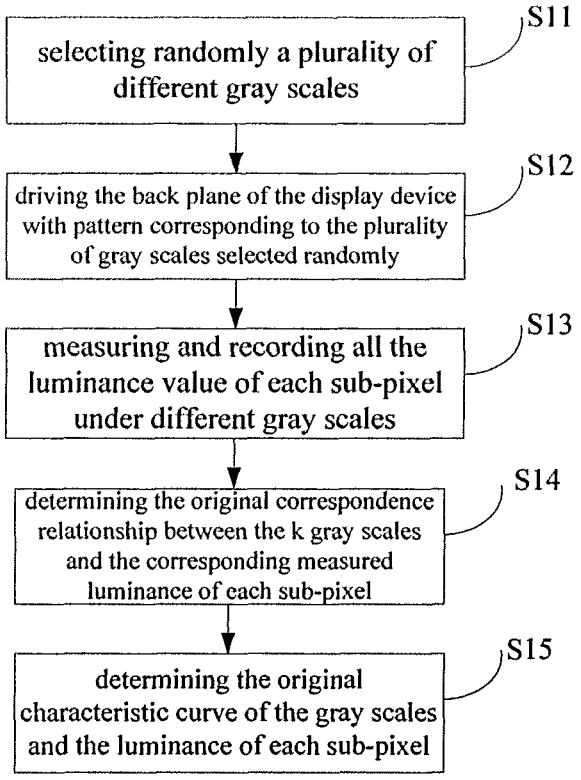
FIG. 3 is a flow chart of a method for determining an original characteristic curve of a gray scale and a luminance provided by an embodiment of the present disclosure.

Referring to FIG. 3, the determination of the original characteristic curve of the gray scales vs. the luminance comprises steps as follows:

S11: selecting randomly a plurality of different gray scales for the R, G, B sub-pixels respectively, the gray scales are sampling gray scales;

For example, selecting k (k=1, 2, 3, 4, . . . ) different gray scales are selected respectively, and the set of gray scales obtained therefrom can be represented as $(G_1, G_2, G_3, G_4, G_5, \ldots G_k)_{R,G,B}$.

S12: the back plane of the display device is illuminated by respectively driving the back plane with pattern corresponding to each gray scale selected randomly; the back plane is driven every time, one and the same gray scale is used for all the sub-pixels at each time of driving.

Specifically, the back plane is illuminated for k times with $G_1, G_2, G_3, G_4, G_5, \ldots G_k$ respectively.

It should be noted that, the back plane is driven with only a monochromatic pattern corresponding to a gray scale at each time of driving back plane, all the sub-pixels on the back plane are driven by the monochromatic pattern corresponding to each gray scale, and several (I*J*k) luminance values are obtained by driving the back plane for k times.

Each gray scale corresponds to the luminance values corresponding to I*J sub-pixels, and the luminance value of each sub-pixel is labeled as $L_{i,j,x}$, which represents the luminance value of the $x^{th}$ gray scale $G_x$ corresponding to the sub-pixel in the $i^{th}$ row and $j^{th}$ column.

S13: measuring and recording all the luminance values $L_{i,j,x}$ of each sub-pixel under different gray scales, that is, obtaining k measured luminance values corresponding to each sub-pixel under k different gray scales.

Specifically, the luminance values of I*J sub-pixels corresponding to each gray scale are measured and recorded by means of a CCD photometer with high resolution. The set of luminance values can be represented as $(L_{ij,1}, L_{ij,2}, L_{ij,k})_{R,G,B}$, wherein the $L_{ij,x}$ denotes the luminance value of the gray scale $G_x$ corresponding to the sub-pixel in the $i^{th}$ row and $j^{th}$ column, x=1, 2, 3, . . . k.

S14: determining the original corresponding relationship between the k gray scales and the k measured luminance of each sub-pixel.

Figure 4:
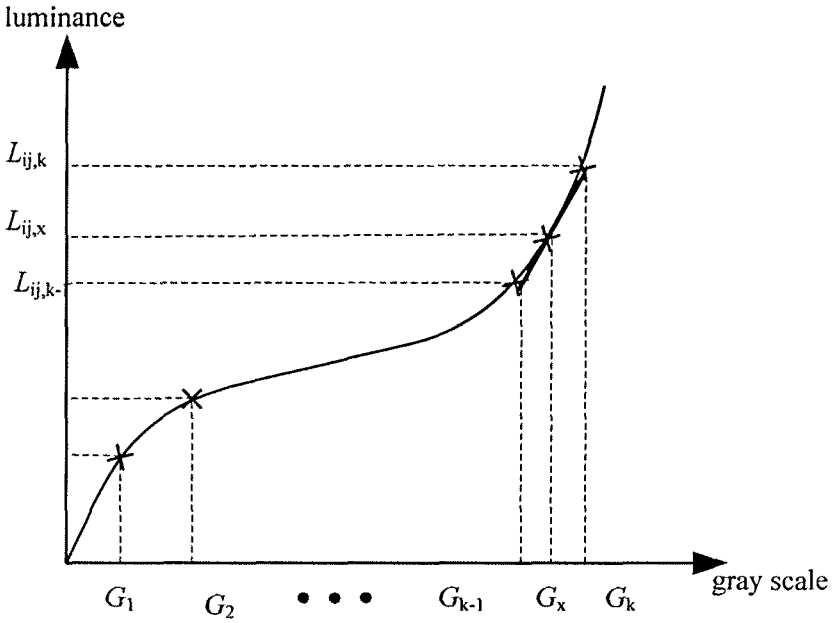
FIG. 4 is a diagram of an original corresponding relationship between k gray scales versus luminance provided by an embodiment of the present disclosure.

Specifically, taking the gray scale as a variable x, taking the luminance obtained from the CCD measurement at step S13 as a variable y, and each gray scale corresponding to one luminance, the original corresponding relationship between the gray scales and the luminance for the sub-pixel in the $i^{th}$ row and $j^{th}$ column can be obtained as follows: $[(G_1,L_{ij,1}), (G_2,L_{ij,2}), \ldots (G_k,L_{ij,k})]_{R,G,B}$. The obtained original corresponding relationship between the k gray scales and the k luminance is illustrated in FIG. 4.

S15: determining the original corresponding relationship between the plurality of gray scales and the luminance of each sub-pixel.

Specifically, by making an interpolation calculation, the original characteristic curve of the gray scales vs. the luminance of each sub-pixel is obtained on the original corresponding relationship between the k gray scales and the luminance.

Specifically, since the original characteristic curve of the gray scales vs. the luminance is usually a curve without inflexion, and a luminance difference corresponding to two adjacent gray scales is small, it can be approximately considered that a linear relationship is presented between the luminance values corresponding to the two adjacent gray scales and the gray scales. Therefore, given that the luminance values corresponding to the two adjacent gray scales $G_{M-1}$ and $G_M$ are $L_{ij,k-1}$ and $L_{ij,k}$, the luminance corresponding to a gray scale $G_x$ between these two gray scales can be represented as the following formula:

$$L_{ij,x} = L_{ij,M-1} + \frac{L_{ij,M} - L_{ij,M-1}}{G_M - G_{M-1}} \times Gx \qquad (1-1)$$

Wherein, the $L_{ij,x}$ denotes the luminance value of the $x^{th}$ gray scale $G_x$ corresponding to the sub-pixel in the $i^{th}$ row and $j^{th}$ column, the $L_{ij,M-1}$ denotes the luminance value of the $M-1^{th}$ gray scale $G_{M-1}$ corresponding to the sub-pixel in the $i^{th}$ row and $j^{th}$ column, the $L_{ij,M}$ denotes the luminance value of the $M^{th}$ gray scale $G_M$ corresponding to the sub-pixel in the $i^{th}$ row and $j^{th}$ column, M−1<x<M.

The luminance values corresponding to the respective sub-pixels in all the gray scales can be obtained by the luminance vs. gray scale relationship in the formula (1-1), and thus the original characteristic curve of the gray scales vs. the luminance can be obtained.

Figure 5:
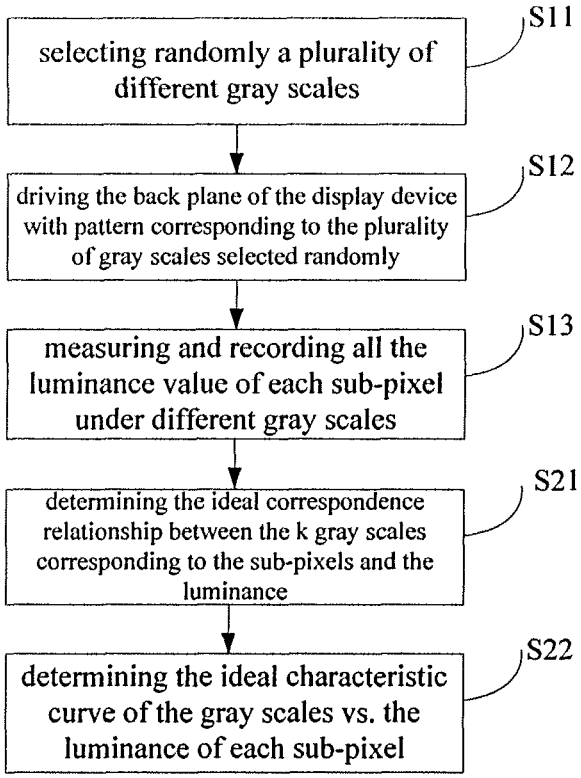
FIG. 5 is a flow chart of a method for determining an ideal characteristic curve of the gray scale and the luminance provided by the embodiment of the present disclosure.

Referring to FIG. 5, the determination of the ideal characteristic curve of the gray scales vs. the luminance comprises steps as follows:

The k measured luminance values corresponding to k different gray scales of each sub-pixel are obtained by the method at step S11 to S13 as shown in FIG. 3.

S21: determining the ideal corresponding relationship between the k gray scales and the luminance of each sub-pixel.

As for a certain sub-pixel, a certain gray scale, the ideal corresponding relationship between the k gray scales and the luminance corresponding to the sub-pixel is obtained by summing and averaging the measured luminance of the plurality of sub-pixels (all or part of the sub-pixels) corresponding to the gray scale measured and obtained at step S13.

The ideal corresponding relationship between the k gray scales and the luminance of each sub-pixel are the same.

Specifically, it is known that the measured luminance of the gray scale $G_x$ corresponding to the sub-pixel in the $i^{th}$ row and $j^{th}$ column is the $L_{ij,x}$, measured luminance of the gray scale $G_x$ corresponding to all or part of the sub-pixels is $\mathring{a}L_{ij,x}$, the ideal luminance of each sub-pixel under the gray scale $G_x$ is Lx. The relationship between the Lx and the $L_{ij,x}$ is shown as formula (1-2).

$$Lx = \frac{\mathring{a}L_{ij,x}}{n} (x = 1, 2, 3, \ldots k) \qquad (1-2)$$

Wherein, n denotes the number of the measured luminance participating in the summation, i.e. the number of the sub-pixels corresponding to the measured luminance participating in the summation, and the n can be the number of all or part of the sub-pixels.

The sub-pixels of which part of measured luminance value is close to the ideal luminance value can be used as the sub-pixels corresponding to the measured luminance participating in the summation, and the obtained ideal luminance is Lx close to the ideal value. Or, the measured luminance values corresponding to all the sub-pixels can be used as the luminance values participating in the summation, and the number of the sub-pixels can be determined according to the actual requirement specifically.

Thus, the ideal luminance values of all the sub-pixels corresponding to each gray scale among the k different gray scales are obtained, and represented as: $[(G_1,L_1), (G2,L_2), (G_3,L_3), \ldots (G_k,L_k)]$.

As for a gray scale Gx, the ideal gray scale of all the sub-pixels Gx is identical, and is Lx uniformly.

In the embodiment in practice, after the k measured luminance values corresponding to the k different gray scales of each sub-pixel is obtained by the method at steps S11 to S13, the k measured luminance values are used and at the same time the original corresponding relationship between the gray scales and the luminance corresponding to the respective sub-pixels and the ideal corresponding relationship between the gray scales and the luminance are determined, such that the calculation overhead is reduced, and the efficiency of controlling the image display is improved.

The original corresponding relationship between the gray scales and the luminance or the ideal corresponding relationship between the gray scales and the luminance corresponds to the relationship between any gray scale and the corresponding luminance, the respective gray scales are continuous, and all the gray scales are consisted of infinite continuous gray scales.

The original corresponding relationship between the k gray scales and the luminance or the ideal corresponding relationship between the k gray scales and the luminance corresponds to the relationship of any gray scale and the corresponding luminance, the respective gray scales are discrete, all the gray scales are consisted of finite discrete gray scales.

In addition, the ideal luminance corresponding to the k gray scales or all the gray scales of each sub-pixel can be determined by people according to actual requirement. When the ideal luminance corresponding to each gray scale is determined, the ideal corresponding relationship between the gray scales and the luminance is determined.

Or, the ideal luminance corresponding to the k gray scales or all the gray scales of each sub-pixel can be set according to gamma 2.2, that is, the corresponding relationship between each ideal gray scale and the luminance follows the setting of gamma 2.2.

S22: determining the ideal characteristic curve of the gray scales vs. the luminance of each sub-pixel.

Being the same as the method for determining the original characteristic curve of the gray scales vs. the luminance at step S15, the ideal characteristic curve of the gray scales vs. the luminance is obtained by method of interpolation, which is not described in detail herein.

Figure 6:
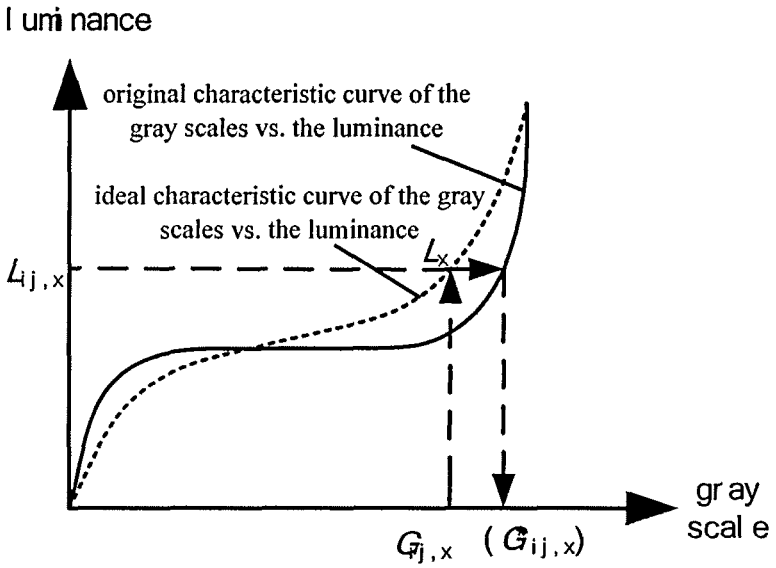
FIG. 6 is a diagram of an original characteristic curve of the gray scales vs. the luminance and an ideal characteristic curve of the gray scales vs. the luminance provided by an embodiment of the present disclosure.

FIG. 6 shows the original characteristic curve and the ideal characteristic curve of the gray scales vs. the luminance obtained at steps S15 and S22. The abscissa of rectangular coordinates represents the gray scale, and the ordinate thereof represents the luminance.

The luminance corresponding to the respective sub-pixels in the current frame display image can be collected by CCD. The gray scales displaying the current frame image can be obtained from the image data being displayed.

Figure 7:
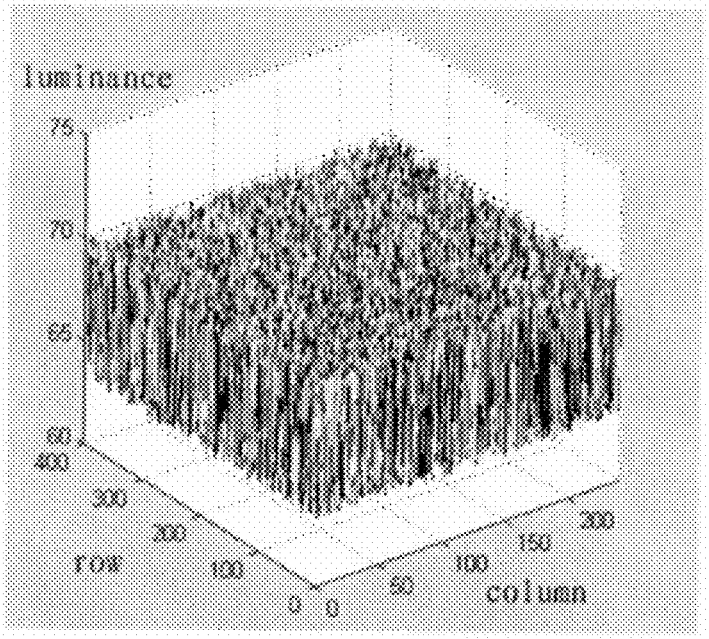
FIG. 7 is a diagram of display effect before an adjustment of the gray scale according to an embodiment of the present disclosure.
Figure 8:
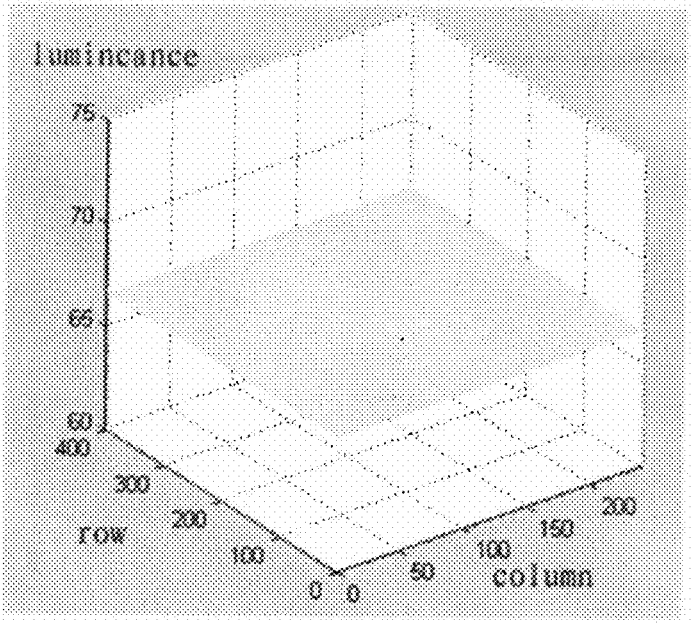
FIG. 8 is a diagram of display effect after an adjustment of the gray scale according to the embodiment of the present disclosure.

In order to validate the method of controlling image display according to the embodiment of the present disclosure, the compensation effect of one 240RGBX400 display panel has been simulated using experiments. In order to simulate the nonuniformity of the panel, the original corresponding relationship between the gray scales and the luminance of the respective sub-pixels is produced randomly, when no compensation scheme is adopted, the actual display effect is shown in FIG. 7, about 10% of luminance nonuniformity is presented; while the display effect obtained through adopting the compensation method of the present disclosure is shown in FIG. 8, which is very close to the original image, there is only a luminance difference less than 0.1%.

In the scheme of controlling image display provided by the embodiment of the present disclosure, it doesn't need too many measurement patterns, only finite gray scales need to be selected and the actual luminance of image corresponding to the selected gray scales is measured, and then the compensation of all the gray scales corresponding to all the sub-pixels can be achieved, so that the compensation of the luminance corresponding to all the gray scales can be achieved, and thus the display of image is controlled.

In the method for controlling image display provided by the embodiments of the present disclosure, the gray scales of all the sub-pixels are effectively compensated, the compensation precision is high, the compensation efficiency is high, and low cost is achieved.

Figure 9:
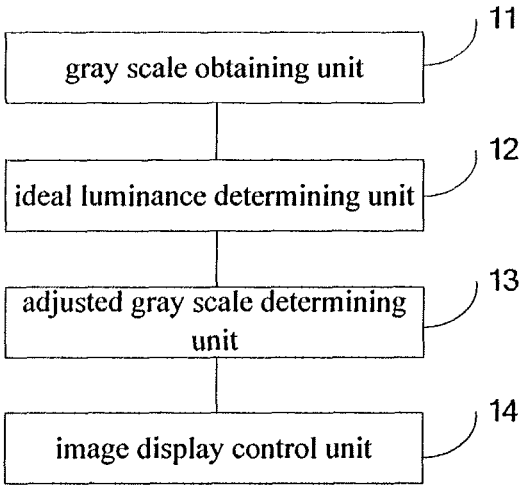
FIG. 9 is a structure diagram of an apparatus for controlling image display provided by an embodiment of the present disclosure.

Referring to FIG. 9, the embodiments of the present disclosure also provide an apparatus of controlling image display, the apparatus comprises:

a gray scale obtaining unit 11, for reading gray scales of all of sub-pixels of a display device displaying a current frame image;

an ideal luminance determining unit 12, for determining ideal luminance corresponding to the gray scales according to a predetermined ideal corresponding relationship between the gray scales and the luminance of respective sub-pixels, respectively;

an adjusted gray scale determining unit 13, for determining an adjusted gray scale corresponding to the ideal luminance according to a predetermined original corresponding relationship between the gray scales and the luminance of respective sub-pixels, respectively;

an image display control unit 14, for driving the display device to display the current frame image according to the adjusted gray scale.

Preferably, the ideal corresponding relationship between the gray scales and the luminance of respective sub-pixels is characterized by an ideal characteristic curve of the gray scales vs. the luminance, or characterized by an ideal corresponding relationship between the gray scales and the luminance stored in a table;

The original corresponding relationship between the gray scales and the luminance of respective sub-pixels is characterized by an original characteristic curve of the gray scales vs. the luminance, or characterized by an original corresponding relationship between the gray scale and the luminance stored in a table.

Figure 10:
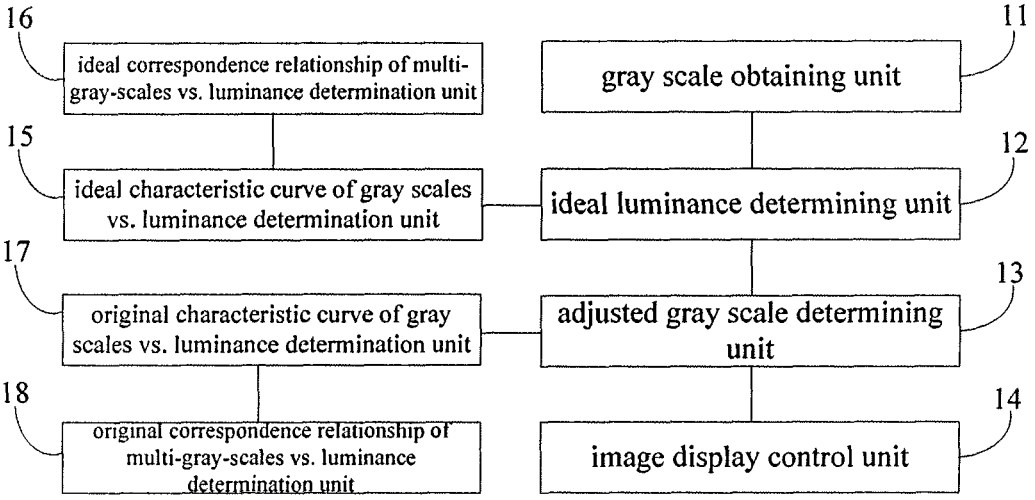
FIG. 10 is a structure diagram of another apparatus for controlling image display provided by an embodiment of the present disclosure.

Referring to FIG. 10, the apparatus further comprises:

an ideal characteristic curve of gray scales vs. luminance determination unit 15, for determining the ideal characteristic curve of the gray scales vs. luminance of the sub-pixels;

Specifically, the ideal characteristic curve of gray scales vs. luminance determination unit 15 is particularly used for determining the ideal corresponding relationship of the plurality of gray scales vs. the luminance of each sub-pixel; making interpolation calculation on the ideal corresponding relationship between the plurality of gray scales and the luminance of each sub-pixel respectively, and obtaining the ideal characteristic curve of the gray scales vs. the luminance of the sub-pixels.

The apparatus further comprises:

an ideal corresponding relationship of a plurality of gray scales vs. luminance determination unit 16, for determining the ideal corresponding relationship of the plurality of gray scales vs. the luminance of each sub-pixel; the ideal corresponding relationship of a plurality of gray scales vs. luminance determination unit 16 is particularly used for selecting the plurality of gray scales, driving the display device with the gray scales respectively to display images corresponding to the gray scales; measuring and recording the luminance of all the sub-pixels corresponding to each gray scale from among the displayed images; summing and averaging the luminance of all the sub-pixels corresponding to each gray scale respectively, obtaining the ideal luminance corresponding to the selected gray scales, and obtaining the ideal corresponding relationship between the plurality of selected gray scales and the luminance of each sub-pixel.

The apparatus further comprises:

Original characteristic curve of a plurality of gray scales vs. luminance determination unit 17, for predetermining the original characteristic curve of the gray scales vs. the luminance of the sub-pixels by measuring a back plane;

The original characteristic curve of a plurality of gray scales vs. luminance determination unit 17 is particularly used for predetermining the original corresponding relationship of the plurality of gray scales vs. the luminance of each sub-pixel, making an interpolation calculation on the original corresponding relationship between the plurality of gray scales and the luminance of each sub-pixel respectively, and obtaining the original characteristic curve of the gray scales vs. the luminance of the sub-pixels.

The apparatus further comprises:

an original corresponding relationship of a plurality of gray scales vs. luminance determination unit 18, for predetermining the original corresponding relationship of the plurality of gray scales vs. the luminance of each sub-pixel by measuring the back plane;

The original corresponding relationship of a plurality of gray scales vs. luminance determination unit 18 is particularly used for selecting the plurality of different gray scales, driving the display device with the gray scales respectively to display images corresponding to the gray scales; measuring and recording the luminance of all the sub-pixels corresponding to each gray scale among the displayed images, obtaining the luminance corresponding to the selected different gray scales of each sub-pixel, and obtaining the original corresponding relationship between the plurality of selected gray scales and the luminance of each sub-pixel.

To sum up, in the method of controlling image display provided by embodiments of the present disclosure, gray scale of all of sub-pixels of a current frame image is displayed by reading a display device; ideal luminance corresponding to the gray scales is determined according to a predetermined ideal corresponding relationship between the gray scales and luminance of respective sub-pixels respectively; an adjusted gray scale corresponding to the ideal luminance is determined according to a predetermined original corresponding relationship between the gray scales of respective sub-pixels and the luminance respectively; the display device is driven to display the current frame image according to the adjusted gray scale. The picture whose image display is controlled by said method can be displayed uniformly, and there is phenomenon of image-retention.

It is obvious that those skilled in the art can make some amendment and variations to the present disclosure without departing from the spirit and scope of the present disclosure. And thus, if these amendments and variations of the present disclosure belong to the scope of the present disclosure and the equivalent thereof, they are intended to be encompassed into the present disclosure.

What is claimed is:

1. A method for controlling image display, comprising:

reading gray scales of all sub-pixels of a current frame image displayed by a display device;

determining an ideal luminance corresponding to the gray scale according to a predetermined ideal corresponding relationship between the gray scales and the luminance of respective sub-pixels, respectively;

determining an adjusted gray scale corresponding to the ideal luminance according to a predetermined original corresponding relationship between the gray scales and the luminance of respective sub-pixels, respectively;

driving the display device to display the current frame image according to the adjusted gray scale;

wherein, the ideal corresponding relationship between the gray scale and the luminance of respective sub-pixels is characterized by an ideal characteristic curve of the gray scales vs. the luminance, or characterized by an ideal corresponding relationship between the gray scales and the luminance stored in a table; and the original corresponding relationship between the gray scales and the luminance of respective sub-pixels is characterized by an original characteristic curve of the gray scales vs. the luminance, or characterized by an original corresponding relationship between the gray scales and the luminance stored in a table;

wherein, the ideal characteristic curve of the gray scales vs. the luminance is particularly determined as follows:

determining the ideal corresponding relationship of a plurality of gray scales vs. the luminance of each sub-pixel;

making interpolation calculation on the ideal corresponding relationship between the plurality of gray scales and the luminance of each sub-pixel respectively, to obtain the ideal characteristic curve of the gray scales vs. the luminance of the sub-pixels; and wherein, the ideal corresponding relationship of the plurality of gray scales vs. the luminance of each sub-pixel is particularly determined as follows:

selecting a plurality of different gray scales, driving the display device with the gray scales respectively to display images corresponding to the gray scales;

measuring and recording the luminance of all the sub-pixels corresponding to each gray scale among the displayed images;

summing and averaging the luminance of the plurality of sub-pixels corresponding to each gray scale respectively, obtaining the ideal luminance corresponding to the selected gray scales, and obtaining the ideal corresponding relationship between the plurality of selected gray scales and the luminance of each sub-pixel;

wherein, assuming that there are k gray scales, the measured luminance of the gray scale $G_x$ corresponding to the sub-pixel in the $i^{th}$ row and $j^{th}$ column is the $L_{ij,x}$, the measured luminance of the gray scale $G_x$ corresponding to all or part of the sub-pixels is $\mathring{a}L_{ij,x}$, the ideal luminance of each sub-pixel under the gray scale $G_x$ is Lx, then $$Lx = \frac{\mathring{a}\ L_{ij,x}}{n}$$

$$(x = 1, 2, 3, \ldots k)$$

wherein, n denotes the number of the measured luminance participating in the summation, and the n can be the number of all or part of the sub-pixels.

2. The method according to claim 1, wherein, the original characteristic curve of the gray scales vs. the luminance of the respective sub-pixels is predetermined particularly as follows:

predetermining the original corresponding relationship of the plurality of gray scales vs. the luminance of each sub-pixel by measuring a back plane;

making interpolation calculation on the original corresponding relationship between the plurality of gray scales and the luminance of each sub-pixel respectively, and obtaining the original characteristic curve of the gray scales vs. the luminance of the sub-pixels.

3. The method according to claim 2, wherein, predetermining the original corresponding relationship of the plurality of gray scales vs. the luminance of each sub-pixel by measuring the back plane is particularly as follows:

selecting the plurality of different gray scales, driving the display device with the gray scales respectively to display images corresponding to the gray scales;

measuring and recording the luminance of all the sub-pixels corresponding to each gray scale from among the displayed images, obtaining the luminance corresponding to the selected different gray scales of each sub-pixel, and obtaining the original corresponding relationship between the plurality of selected gray scales and the luminance of each sub-pixel.

* * * * *